United States Patent [19]

Hemsath

[11] Patent Number: 5,052,921

[45] Date of Patent: Oct. 1, 1991

[54] METHOD AND APPARATUS FOR REDUCING $NO_x$ EMISSIONS IN INDUSTRIAL THERMAL PROCESSES

[75] Inventor: Klaus H. Hemsath, Toledo, Ohio

[73] Assignee: Southern California Gas Company, El Monte, Calif.

[21] Appl. No.: 585,932

[22] Filed: Sep. 21, 1990

[51] Int. Cl.[5] ..... F27D 3/00; F23C 6/00

[52] U.S. Cl. ..... 432/121; 432/11; 432/19; 432/28; 431/7; 431/10

[58] Field of Search ..... 432/14, 15, 19, 28, 432/121, 11; 110/262, 263, 264, 347; 431/2, 8, 10, 159, 171, 347, 350, 7

[56] References Cited

U.S. PATENT DOCUMENTS

| | | | |
|---|---|---|---|
| 3,916,805 | 11/1975 | Kalfadelis et al. | 110/345 |
| 4,012,488 | 3/1977 | Brocoff | 431/10 X |
| 4,012,902 | 3/1977 | Schirmer | 431/10 X |
| 4,272,239 | 6/1981 | Thekdi et al. | 432/19 |
| 4,299,565 | 11/1981 | Shinohara | 431/171 X |
| 4,308,810 | 1/1982 | Taylor | 431/10 X |
| 4,517,165 | 5/1985 | Moriarty | 431/2 X |
| 4,652,236 | 3/1987 | Viessmann | 431/350 |
| 4,790,744 | 12/1988 | Bellet et al. | 431/347 X |
| 4,867,674 | 9/1989 | Keller et al. | 431/10 X |
| 4,878,830 | 11/1989 | Henderson | 431/10 |
| 4,915,621 | 4/1990 | Schilling et al. | 431/2 X |

*Primary Examiner*—Henry A. Bennett
*Assistant Examiner*—Christopher B. Kilner
*Attorney, Agent, or Firm*—Body, Vickers & Daniels

[57] ABSTRACT

Nitrous oxide emissions are reduced in an industrial thermal process and system which operates a gas fired burner at substantially sub-stoichiometric conditions to produce products of combustion rich in combustibles and control flame temperatures at temperatures which do not exceed predetermined levels. Completion air at stoichiometric proportions is subsequently employed to burn the combustibles. Regenerative and recuperative means to cool gases after each partial combustion step are used to extract heat and use is in conventional heating processes. A novel regenerative heat exchange system is used to extract heat from the gases so that the gases never exceed a temperature whereat nitrous oxide formation tends to occur.

20 Claims, 4 Drawing Sheets

METHOD AND APPARATUS FOR REDUCING $NO_x$ EMISSIONS IN INDUSTRIAL THERMAL PROCESSES

This invention relates generally to method and apparatus or system for reducing nitrous oxide emissions generated in industrial thermal processes and more particularly to a gas fired, thermal regenerative system and process which generates heat with little, if any, nitrous oxide emissions.

INCORPORATION BY REFERENCE

My U.S. Pat. No. 3,782,883 dated Jan. 1, 1974 entitled "Flat Flame Burner Having a Low Air to Gas Ratio" and U.S. Pat. No. 3,819,323 dated June 25, 1974 entitled "Minimum Scale Preheating Furnace and Means Relating Thereto" are incorporated in their entirety herein by reference and made an integral part hereof so that the description of the present invention need not restate in detail conventional items, processes and concepts already known in the prior art.

BACKGROUND OF THE INVENTION

This invention relates to thermal processes which utilize gas fired burners to generate heat. The invention does not include systems which use solid, i.e. coal, or liquid fuels to generate heat although certain principles set forth below are applicable to solid and liquid fuel fired systems. The reason for this distinction is that in liquid and solid fuels, nitrogen can be chemically bonded to carbon and hydrogen within the fuel. Because of this chemical bond, nitrogen within the fuel is in a reactive state which can more easily form nitrous oxides. (As used herein, $NO_x$ means the various forms of nitrous oxides such as NO, $NO_2$, $N_2O$, etc.) In a gas fired system such as a system utilizing natural gas, nitrogen is not generally present in the fuel. Instead, all the nitrous oxides are formed from the nitrogen within the combustion air which is generally in its unreacted molecular state. As used herein, "gas fired system" means a fuel fired combustion system using natural gas (including methane and small percentages of other elements commonly referred to as "street gas") and its higher order hydrocarbon derivatives such as butane, propane, etc. This invention relates to gas fired systems.

A tremendous effort has been expended in an attempt to reduce $NO_x$ emissions in gas fired systems. The art of reducing $NO_x$ emissions has advanced to the point where $NO_x$ in gas fired systems can be reduced to as low as 20 ppm (parts per million). As a basis for comparison, new, proposed regulations in certain regions of the United States such as California, are being contemplated which would limit the emissions for industrial processes to 9 ppm, a level which, before the present invention, was not obtainable.

The activity in the field of $NO_x$ reduction for industrial systems has been so extensive that it is not practical to cite in this Background section specific articles or specific prior art patents. For purposes of explaining the present invention and distinguishing it from the prior art, the various approaches heretofore used for reducing $NO_x$ emissions in industrial processes can be categorized and defined as follows:

A) There have been numerous attempts made to modify burners to reduce localized flame temperatures. These efforts includes use of excess air in the burners, staging the combustion instituted at the burner to occur in steps, modifying the air/gas mixing pattern, etc.

B) A second type of approach has been to adopt modifications in the combustion system to suppress the temperature of the products of combustion after they normally occur. Such types of modifications include use of water or steam injection into the flame, flue gas recirculation or recycling and process heat transfer related changes.

C) The third fundamental approach may be defined as post combustion flue gas treatment and would include process such as catalytic reduction of $NO_x$ in the presence of reducting gases such as ammonia, hydrogen and carbon monoxide, etc. This is the so-called reburn approach which basically accepts the fact that $NO_x$ formation will inherently occur in the combustion process and then treats the nitrous oxides like any other effluent which is to be cleansed. However, reburning creates its own problems which have to be solved properly to make sure that what is produced in the reburn is not worse than that which otherwise existed.

Because some characteristics of the present invention could conceivably be asserted to bear some resemblance to categories A or B, some further comment may be in order. Basically, given a gas composition that contains nitrogen and oxygen, it is inevitable that nitrous oxides will form if the gases are in the presence of one another for extended time periods at certain elevated temperatures, i.e. above 2800° F., for a reaction time as short as a few hundred milliseconds. That is, composition, temperature and reaction time are the three variables which produce $NO_x$. Now, it is difficult to maintain the reaction zone temperature and residence time at low enough values at all times during the combustion and post combustion steps. For example, when the combustion zone temperature reductions are attempted by one of the techniques mentioned in subparagraph B above, it is very difficult to reduce the high temperature reaction zones at the residence times necessary to achieve low enough levels of $NO_x$ to result in significantly reduced $NO_x$ emissions. Thus, when staged combustion processes such as discussed in subparagraph A above are used, it may be possible to reduce the $NO_x$ levels in the first step of the staged combustion. However, afterburning of the products of combustion within the same general combustion zone will then still result in formation of unacceptable levels of $NO_x$. In summary, all of the prior art processes discussed above are inherently defective in that the $NO_x$ is still being formed and the solution employed is to reduce the severity of the formation which, while "doable", cannot be done to produce the low levels of $NO_x$ which new regulations are going to specify. Further, in most industrial processes, it is now common practice to obtain high fuel efficiencies by preheating the combustion and/or even enriching the oxygen content of the combustion air supplied to the burner. Each of these practices increases flame temperature significantly and this in turn results in considerably higher $NO_x$ formation.

Apart from discussing any of the prior art $NO_x$ processers, there is published literature and prior art workings which can establish the following "facts":

I) At stoichiometric proportions of fuel and air, it is known that significant nitrous oxide emissions will not occur below reaction temperature of approximately 2800° F.

II) It is known to operate burners at sub-stoichiometric air/fuel ratios and burners have been developed which will so operate at such ratios.

III) It is known that the actual flame temperature of burners operated at substoichiometric ratios of air to natural gas will produce lower peak temperatures than when the burners are operated at stoichiometric or excess air conditions.

IV) When a burner is operated at sub-stoichiometric conditions, a reducing atmosphere rich in reducing combustibles will be generated.

The above "facts" are known in the art but only the "fact" identified as I was specifically developed for nitrous oxide emissions. "Facts" II, III and IV are known and have been developed for the industrial furnace art.

SUMMARY OF THE INVENTION

It is thus a principle object of the present invention to provide a gas fired system for use in industrial processes which significantly reduces nitrous oxide emissions when compared to that produced by current systems.

This object along with other features of the invention is achieved in an industrial process for generating a heated gas with minimal $NO_x$ content for heating work which includes the steps of a) combusting a gaseous fuel with combustion air at a sub-stoichiometric ratio which is sufficient to generate a reducing atmosphere rich in hydrogen and carbon monoxide combustibles; b) removing a major portion of the heat generated in this first combustion step; c) adding completion air to the reducing atmosphere produced in step "a" which is sufficient to combust the hydrogen and carbon monoxide combustibles while d) controlling the temperatures of the gaseous products in steps "b" and "c" to be below a predetermined temperature whereat $NO_x$ tends to occur.

Stated another way, an industrial process for heating work by gas with reduced $NO_x$ emission is provided which includes the steps of a) substoichiometric combusting a gaseous fuel with combustion air at a fuel/air ratio which is sufficient to produce reducing agents such as hydrogen and carbon monoxide at a first predetermined temperature whereat $NO_x$, in the presence of said reducing agents, will not form to any substantial extent; b) extracting heat by cooling the gases formed in step (a) to a second predetermined temperature; c) injecting completion air into the cooled gases of step (b) to raise the temperature of said step (b) gases to a third temperature value lower than the first temperature of the gases produced in step (a); and d) cooling the gases in step (c) from the third temperature level to a final exhaust temperature.

In accordance with a more specific aspect of the invention, the combustion of fuel and air at sub-stoichiometric proportions is controlled to produce a flame temperature below a first predetermined temperature. Importantly, prior to injecting completion air to react with the combustibles, the temperature of the products of combustion is reduced to a lower, second predetermined temperature. Significantly, completion air is mixed with the cooled combustibles in stoichiometric proportions and the cooling is sufficient so that the temperature of the gases does not rise during combustion of the combustibles to a level beyond the first predetermined temperature whereat $NO_x$ emissions tend to occur while the fuel is completely combusted to efficiently recover sensible heat therefrom. Thus, the temperature of the burner gases are reduced prior to introduction of the completion air, a step necessary to recover heat from the fuel. Preferably, when the gases are reheated by completion air to the third predetermined temperature, the adiabatic flame temperature of the reheated gases (i.e. the third predetermined temperature) is lower than the first preheated temperature because the gases do not contain the reducing agents present in the rich fumes produced in step (a).

In accordance with a particularly important aspect of the invention, gases produced in step "a" are blown into direct heat transfer contact with objects at a lower temperature placed in the gas flow path to not only control the temperature of the gases but also increase the time period during which the gases are maintained at a desired, relatively low temperature to establish a sufficient reaction time during which the reducing combustibles or agents present in the gas will react with any $NO_x$ inadvertently formed in the burner to produce free nitrogen in the gas free of $NO_x$ prior to introduction of the completion air. In accordance with still another aspect of the invention, it is contemplated that combustion air can be added to the rich fumes in step wise fashion to maintain the rich fume gas temperature at levels slightly below the first predetermined temperature.

In accordance with another important feature of the invention, the temperature control of the gases is achieved with high thermal efficiency by means of a plurality of spherically shaped, heat transfer objects which roll within a sealed, closed loop track and the track is arranged so that a first portion of the track extends within a sealed furnace in heat transfer relationship with work travelling therethrough while a second portion of the track is insulatedly removed from the first portion. The heat transfer objects are heated from the burner gases and from the final flue gases when the objects travel in the second portion of the track while the heat is transferred to the work within the furnace enclosure when the objects travel in the first track portion so that the arrangement functions in a regenerative manner as a heat source to heat work and as a heat sink to cool gases to minimize nitrous oxide emissions.

In accordance with another aspect of the invention, a thermal system for heating work to a predetermined temperature is provided. The system includes a furnace having a sealed furnace enclosure in which work to be heated is placed. A casing is provided which has an uninsulated first portion which extends within the furnace enclosure and a second portion which is insulated from the furnace enclosure. The casing defines a continuous, sealed closed loop track extending through the first and second portions. Each track portion is defined by an entry point and an exit point and arranged so that the entry point of one portion is adjacent the exit point of the other portion. A plurality of heat transfer objects are provided within the track and a mechanism moves the objects about the track from the entry to the exit points of the casing portions. A burner is provided generally adjacent the exit point of the second portion of the casing for firing its products of combustion from the exit point towards the entry point of the second portion of the casing. A burner regulator controls the ratio of fuel and combustion air supplied to the burner to assure sub-stoichiometric burner combustion to produce products of combustion rich in combustibles. A completion air arrangement intermediate the exit and entry points of the second portion of the casing supplies combustion air in stoichiometric proportion to the combustibles at controlled flow rates to assure combustion thereof whereby the objects are heated from contact with the products of combustion in the second portion of the casing and cooled in the first portion of the casing from the work while the temperature of the products of combustion are controlled by contact with the objects in the second portion of the casing to assure that the products of combustion do not exceed a predetermined temperature whereat formation of $NO_x$ emissions tends to occur.

In accordance with another system aspect of the invention, a temperature sensing mechanism is provided for measuring the temperature of the burner gases in the second track portion adjacent the burner and in the second track portion adjacent the completion air injection point and in response to temperatures which are sensed and which exceed a predetermined limit, a controller is actuated to do one or more of any of the following:

i) control the rate of movement of the heat transfer objects about the track, ii) control the rates at which air and fuel are supplied to the burner without changing its preset ratio, and iii) cause the air completion mechanism to lower the rate at which combustion air is supplied to the track portion thus resulting in a system which can be easily controlled to regulate its heat transfer rate while minimizing nitrous oxide emissions produced therein.

It is thus a principal object of the invention to provide a process and a system for reducing nitrous oxide emissions for industrial processes generating heat from fuel fired burners.

It is another object of the invention to provide process and apparatus for industrial heating schemes which utilize indirect heat transfer to and from the work in a thermally efficient manner while also minimizing $NO_x$ formation.

It is yet another object of the invention to provide an industrial heat transfer process and/or system which has high thermal efficiencies.

It is still yet another object of the invention to provide a fuel-fired, industrial heat process and/or system which substantially reduces nitrous oxide emissions heretofore produced even if combustion air used in the burner is preheated and/or the oxygen content of the combustion air is raised.

It is still yet another object of the invention to provide an industrial heating process and/or system which easily meets or exceeds current and contemplated $NO_x$ emission regulatory requirements while also permitting the work to be heated in controlled furnace atmospheres for improved work properties.

Still yet another object of the invention is to provide a method and/or system or apparatus which reduces $NO_x$ emissions in an easily controlled manner by extending reaction times at which burner gases are maintained at predetermined temperatures to dissociate any $NO_x$ emissions inadvertently formed.

These and other objects of the invention will become apparent to those skilled in the art upon a reading and understanding of the Detailed Description which follows.

BRIEF DESCRIPTION OF THE DRAWINGS

The invention may take physical form in certain parts and arrangement of parts, a preferred embodiment of which will be described in detail and the accompanying drawings which form a part hereof and wherein.

DETAILED DESCRIPTION OF THE PREFERRED EMBODIMENT

Figure 1:
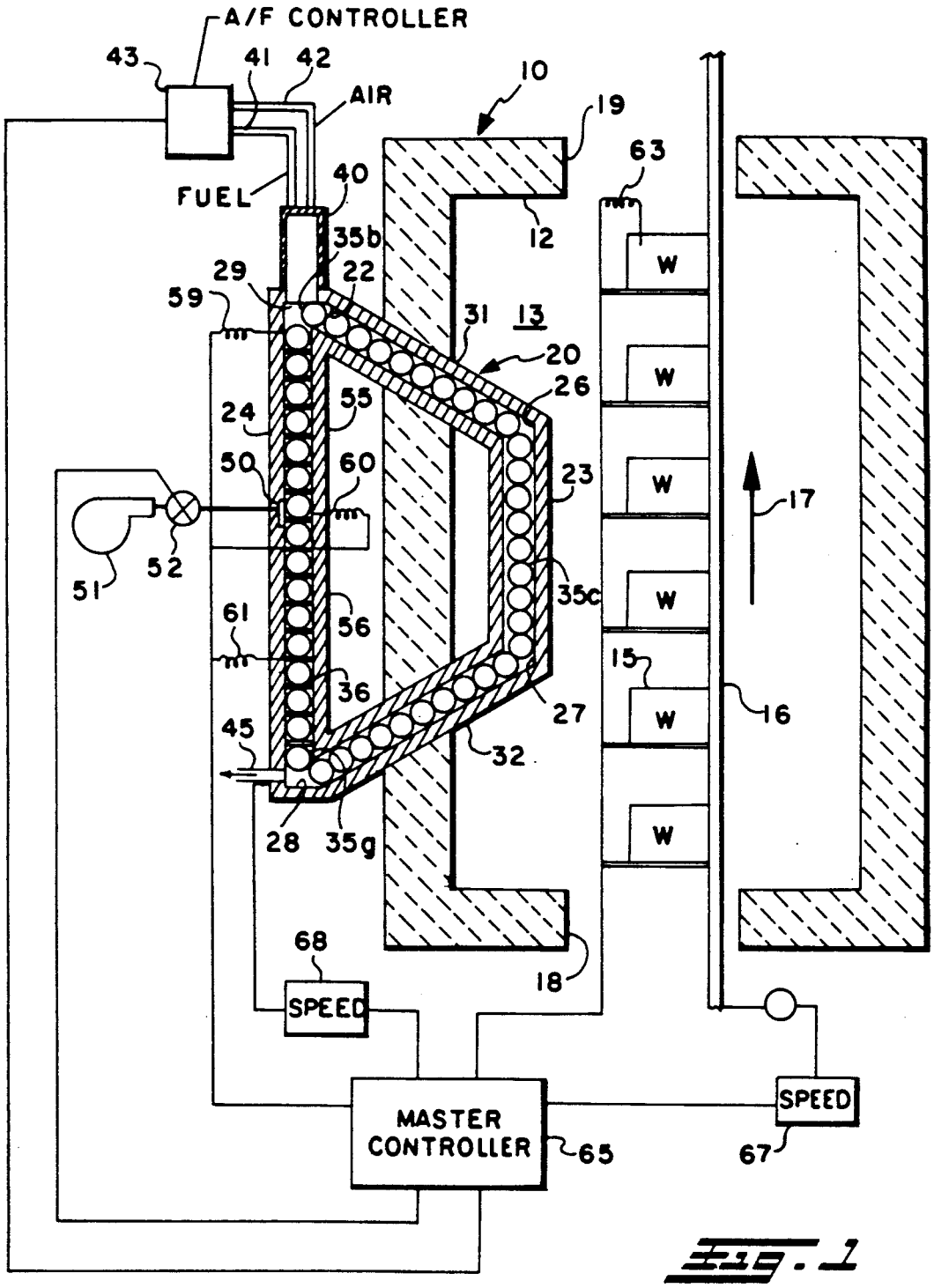
FIG. 1 is a schematic plan view of the system of the present invention.

Referring now to the drawings wherein the showings are for the purpose of illustrating a preferred embodiment of the invention only and not for the purpose of limiting the same, there is schematically shown in FIG. 1 a furnace 10 which has an insulated wall construction 12 which defines a sealed furnace enclosure 13. Work 15 travels on an endless belt 16 in the direction of arrow 17 into furnace enclosure 13 through an inlet 18 whereat the work is heated and then exits furnace 10 through an outlet 19. Conventional means such as gas jets can be used to seal inlet 18 and outlet 19 from ambient atmosphere. It is to be appreciated that furnace 10 and the term "furnace" is used herein in a general sense to simply mean some structure which is insulated and into which work is placed for the purpose of heating thereof by indirect application of heat. The reason for heating the work, i.e. the process, is somewhat conceptually irrelevant to the invention except for the general distinctions discussed below.

The heat which is supplied to furnace enclosure 13 is effected through a tubular casing 20 which extends through insulated wall 12 of furnace 10. Tubular casing 20 is preferably cylindrical to define by its interior surfaces a closed loop or circuitous track 22. Casing 20 can be formed from high temperature alloy steels similar to that used in the manufacture of radiant heat tubes currently used in the industrial furnace art. It can also be manufactured from ceramic materials. For comparison, casing 20 will heat work 15 in furnace enclosure 13 in the same general manner that radiant tubes are employed to heat the work in the industrial furnace field art.

Casing 20 is conceptually defined to have a first portion 23 which is continuous or contiguous with a second portion 24. First portion 23 extends within furnace enclosure 13 and is insulated or sealed from the outside atmosphere by furnace wall 12. Second portion 24 is outside of furnace 10 and is shielded or insulated from furnace enclosure 13 likewise by wall 12. Optionally, second portion 24 could also be shielded from outside atmosphere as well as from first portion 23. First portion 23 has an entry point 26 and an exit point 27 and second portion 24 likewise has an entry point 28 and an exit point 29 and the first and second portions 23, 24 are so arranged that the entry point 26, 28 of one portion 23, 24 is adjacent the exit point 27, 29 of the other portion 23, 24 and visa versa. In the preferred embodiment disclosed in FIG. 1, there is provided intermediate casing portions 31, 32 which are interposed between first and second portions 23, 24 and provide a connection between entry points 26, 28 and exit points 27, 29. Those skilled in the art will recognize that what is being defined is a circuitous track which in point of fact is divided into two portions by a theoretical insulating line and it is in this manner that casing 21 is defined. In practice, furnace wall 12 is thick. There is a transition in the passage of the casing therethrough and as a matter of definition the transition is defined as intermediate casing portions 31, 32.

Substantially filling track 21 in somewhat continuous end-to-end contact is a plurality of heat transfer objects 35. In the preferred embodiment and because casing 20 is cylindrical, heat transfer objects 35 take the form of spherically shaped balls. Preferably, heat transfer objects 35 are made from conventionally available ceramic refractory material used in the furnace art. Alternatively, the balls could be high alloy stainless steel.

A conveying mechanism schematically illustrated as 36 is provided to cause balls 35 to roll by gravity about track 21 from entry point 26 to exit point 27 of first portion 23 and by the conveyor from entry point 28 to exit point 29 of second portion 24. Conveying mechanism 36 could take the form of an endless belt path containing ball moving structure passing through a sealable slit in casing 20. Alternatively and perhaps preferably, hydraulic or pneumatic pusher mechanisms similar to that employed in the industrial furnace art can be provided at entry point 28 of second portion 24 with a stroke sufficient to advance the bottom ball **35*a* by a distance at least equal to its diameter causing all the other balls to then advance a diametrical distance, etc. When the top ball 35*b* reaches entry point 26 of first portion 23, gravity then causes the balls to index one diametrical distance to the entry point 28 of second portion 24, etc. Other mechanisms to move the balls about track 21 and other configurations of track 21** will suggest themselves to those skilled in the art.

A burner 40 is provided adjacent exit point 29 of second portion 24 and fires its products of combustion from exit point 29 to entry point 28 counter to the movement of heat transfer balls 35. More specifically, the products of combustion leave burner 40 and travel down track 22 which is filled with heat transfer balls 35. Thus, the burner gases follow a tortuous path between heat transfer balls 35 and track 22 before exiting second portion 24 at flue outlet 45 which is adjacent entry point 28 of second portion 24. A conventional baffle (not shown) is provided in flue outlet 45 which is regulated to open or close flue outlet 45 and create a draft or back pressure within second portion 24 controlling velocity of gas flow within second portion 24. The gases exiting second portion 24 are "spent" in the sense that they have been in heat transfer contact with heat transfer balls 35 and have given up their available or sensible heat even though they are at an elevated temperature when they leave second portion 24. The spent gases are also clean in the sense that they do not contain any significant $NO_x$ emissions or any other harmful or hazardous emissions. The gas exiting flue 45 is thus inert and as such can be piped to and used as the furnace atmosphere within furnace enclosure 13.

Burner 40 is of the type which has a low air to gas ratio for reasons to be explained hereafter. One such typical burner is illustrated in my prior U.S. Pat. No. 3,782,883 which as noted above is incorporated herein by reference and made a part hereof. A fuel line 41 and a combustion air line 42 is provided to feed natural gas and air at a predetermined ratio established by a conventional gas and air valve regulator which can be varied by a controller. A regulator and controller is schematically illustrated by box 43 and again is conventional. Also, while the available or sensible heat from the gases has been given up to heat transfer balls 35, the gases are at an elevated temperature in flue outlet 45. Thus, not shown, but conventional and within the scope of the invention, is a heat exchanger which can be placed in contact with the exhaust gases at flue outlet 45. The heat exchanger would then preheat combustion air in air line 42 in a conventional manner to result in improved burner efficiencies as is conventionally known in the art. Along the same line, excess or oxygen enriched combustion air can be conventionally provided by air line 42. As noted above, while reheating combustion air and enriching the oxygen content of combustion air are known techniques typically applied to improve thermal burner performance, such techniques materially increase nitrous oxide emissions because the flame temperature is typically driven to higher levels.

As thus far described, the thermal efficiency of the system and process should be somewhat now apparent. Heat exchange balls 35 in second portion 24 are heated by direct contact with the products of combustion emanating from burner 40. When the now heated and hot heat transfer ball **35*b* leaves exit point 29 of second portion 24 it will, in the preferred embodiment disclosed in FIG. 1, roll by gravity in track 21 through intermediate casing portion 31 into first portion 23 and then by gravity through intermediate casing portion 31 to entry point 28 of second portion 24. As heated heat transfer ball 35*c* rolls from entry point 26 to exit point 27 of first portion 23, heat is radiated from second portion 24 of casing 20 to work 15 which absorbs the radiated heat. In turn, heat transfer ball 35*c* gets cooled as it gives up its heat to work 15 so that heat transfer ball 35 is cooled when it reaches entry point 28 of second portion 24. As heat transfer ball 35*a* travels second portion 24 from entry to exit points 28, 29, it becomes progressively heated by contact with the burner products of combustion. Thus, tubular casing 20 is acting in a dual function as both a heat sink and a heat source to inherently produce a regenerative thermally efficient device. Specifically, the hot heat transfer balls 35 in first portion 23 are acting as a heat source to impart heat to work 15 while the cooled balls which, inherently become cool because of the heat transfer to work 15, are then used as a heat sink in second portion 24 of tubular casing 20 to control the temperature of the products of combustion emanating from burner 40** for reasons which will be shortly explained.

Intermediate to entry and exit points 28, 29 of second portion 24 is a completion air zone 50 which is provided in casing 20 and which provides a point at which air is emitted to track 21 vis-a-vis a conventional blower 51 and valve regulator 52 which can precisely meter combustion air to track 21. Completion air zone 50 is so configured that completion air is injected into second portion 24 so that it flows from completion air zone inlet 50 to flue outlet 45. In fact, completion air zone inlet 50 divides second portion 24 into a first segment 55 which extends from entry point 28, i.e. adjacent burner 40 to completion air zone inlet 50 and a second segment 56 which extends from completion air inlet 50 to exit point 29, i.e. adjacent flue outlet 45. Completion air zone inlet 50 is shown more or less as a point source for introduction of combustion air. It is to be understood that depending upon the particular application, a plurality of air zone inlets could be staggered along the length of second segment 56.

Within first segment 55 there are two points of temperature control. The first point is represented by first thermal couple 59 which is placed adjacent burner 40 to monitor the temperature of the products of combustion emanating from burner 40. The second point of temperature control is represented by second thermal couple 60 which is also positioned in first segment 55 and senses the temperature of the products of combustion emanating from burner 40 downstream of burner 40 but prior to introduction of completion air at completion air inlet 50. The final point of temperature control is represented by third thermal couple 61 which is positioned within second segment 56 to measure the temperature of the gases as completion air is emitted, mixed and combusted therewith. The temperature control points measured by first, second and third thermocouples 59, 60, 61 along with temperature of work 15 as measured by fourth thermocouple 63 within furnace enclosure 13 provide the only input which is necessary to control the entire process. That is, the electrical signals generated by first, second, third and fourth thermocouples 59, 60, 61, and 63 are fed into a programmable microprocessor controller 65 which is conventional and which is currently in use within the industrial furnace art field. In response to the temperature sensed, programmable controller 65 can do any of the following to obtain process control:

a) Programmable controller 65 can regulate speed controller 67 which in turn controls the rate at which the work 15 is moved through furnace enclosure 13 by endless belt 16. The speed of the work through furnace enclosure 13 affects the rate at which heat is extracted from first casing portion 23.

b) Programmable controller 65 can also regulate a conveyor controller 68 which in turn regulates the rate at which heat transfer objects 35 travel about track 21.

c) Programmable controller 65 can also regulate valve regulator 52 to control the rate as well as the volume of completion air emitted to completion air inlet 50 which in turn also controls the back pressure of the gases within second portion 24 by regulating the valve in flue outlet 45.

d) Finally, programmable controller 65 can also regulate the air/fuel ratio established by controller 43.

Thus, the system functions by sensing four temperature points and regulating four variables in response to the temperatures sensed to heat the work to the desired output temperature with minimal, if any, measurable nitrous oxide emissions from flue outlet 45. Other control arrangements will suggest themselves to those skilled in the art.

PROCESS

Having thus described the system in terms of the minimized apparatus required for the system to work, discussion will now be had with respect to the process characteristics of the invention. Reference will first be had to the graphs shown in FIGS. 2, 3 and 4 which represent published material reflecting current knowledge in the literature. In addition and within the literature, there are a number of teachings which indicate that for air and natural gas (methane) which are mixed in stoichiometric proportion to produce complete combustion, nitrous oxide emissions will significantly be reduced at temperatures below 2800° F.

Figure 4:
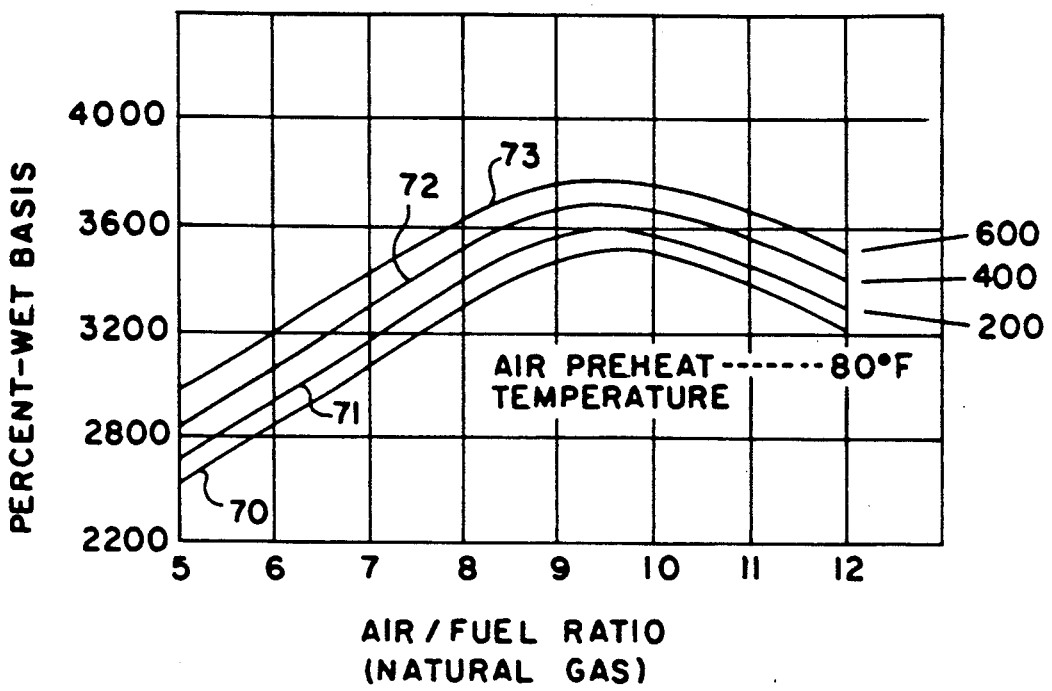
FIG. 4 is a graph showing the flame temperature of gas fired burners operating at various air/fuel ratios with preheated air at various temperatures.

FIG. 4 is a graph of the actual, measured flame temperature (on the y axis) versus the air/fuel ration (on the x axis). Curves 70, 71, 72 and 73 thus represent burner flame temperature for various air/fuel ratios when the combustion air is supplied, respectively, at ambient temperatures (80° F), 200° F., 400° F. and 600° F. It is thus known from FIG. 4 that the measured flame temperature produced by a burner drops as the air to fuel ratio inputted to the burner decreases. FIG. 4 also establishes the well-known fact that the maximum flame temperature occurs at about stoichiometric mixing and that the use of the preheated combustion air raises the flame temperature at all air/fuel ratios.

Figure 2:
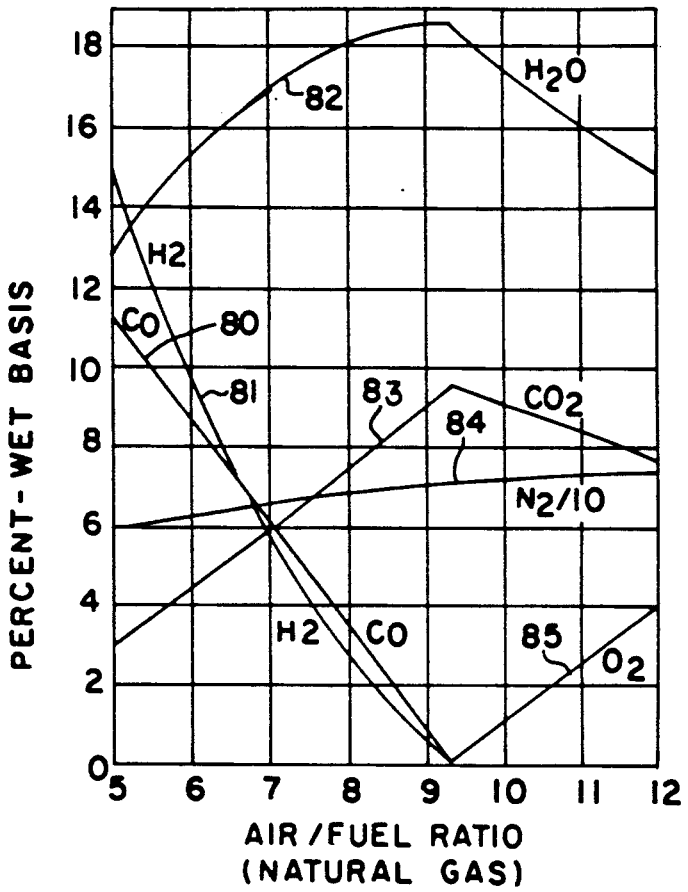
FIG. 2 is a graph of the percentages of the products of combustion produced in a gas fired burner operated at various air/fuel ratios.

FIG. 2 is a chart showing the percentage composition (y axis) of the various gaseous elements ejected from a burner which operate at various air/fuel ratios (x axis). As used herein and also as used in the claims set forth below, the term "products of combustion" means the gaseous elements ejected from the burner in whatever form they are even if they should include trace elements of unreacted fuel, i.e. $CH_4$. In FIG. 2, the curves for the percent composition of the combustibles is shown for carbon monoxide by reference numeral 80 and for hydrogen by reference numeral 81. Water vapor is shown by reference numeral 82, carbon dioxide by reference numeral 83, nitrogen by reference numeral 84 and oxygen by reference numeral 85. It is appreciated that nitrous oxides which are present in ppm ratios will not appear in FIG. 2 as will other trace gases falling within the definition of products of combustion. FIG. 2 shows that when the burner operates with air/fuel mixtures at or slightly above stoichiometric proportions, the $H_2$ and CO components, i.e. the combustibles, reduce to zero. FIG. 2 also shows that when the burner operates at excess air or with oxygen-enriched air, oxygen exists within the flame which simply promotes formation of nitrous oxide emissions. Thus, it is known that when a burner operates with air and fuel mixed at sub-stoichiometric conditions, combustibles including $H_2$ and CO will exist in the products of combustion and oxygen will not exist.

Figure 3:
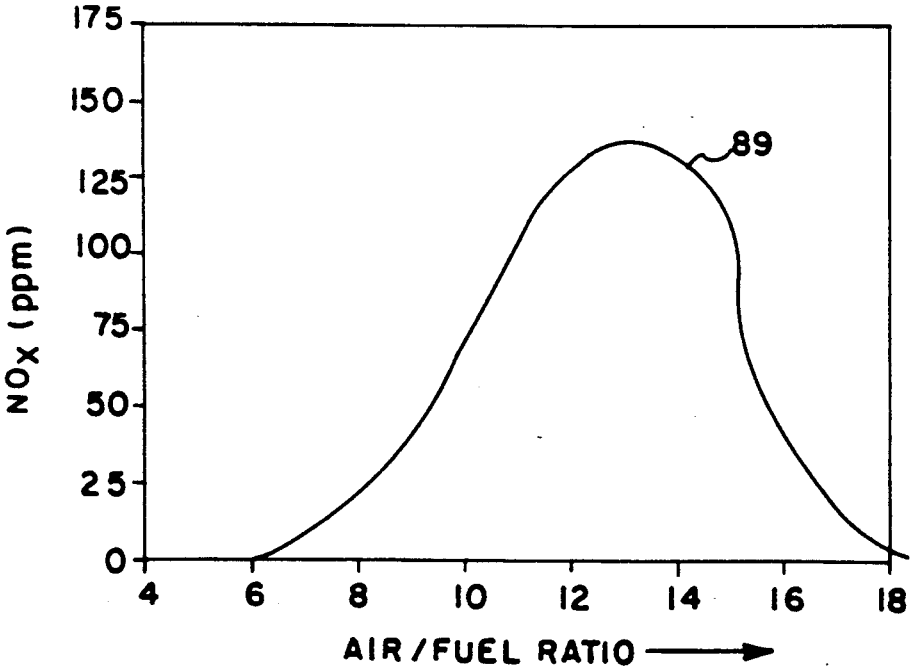
FIG. 3 is a graph of measured $NO_x$ emissions produced by burners operating at various fuel/air equivalent ratios.

FIG. 3 is a published chart showing nitrous oxide emissions in parts per million (y axis) versus various fuel/air ratios (x axis). The graph in FIG. 3 represent the nitrous oxide emissions produced in three milliseconds of reaction time which were recorded experimentally. Graph 89 thus shows that at an air to fuel ratio of less than about 7:1, no measurable ppm of $NO_x$ is produced.

In summary of the state of the art, it is known that if free nitrogen, $N_2$, and oxygen, $O_2$, exists at temperatures in excess of 2800° F. for a sufficient reaction time period measured in hundredths of a millisecond, nitrous oxide will form. If the burner were operated very rich, i.e. significantly sub-stoichiometric, flame temperature could be reduced and, at least as indicated by experimental data, the emissions of nitrous oxide be reduced in ppm significantly.

Figure 5:
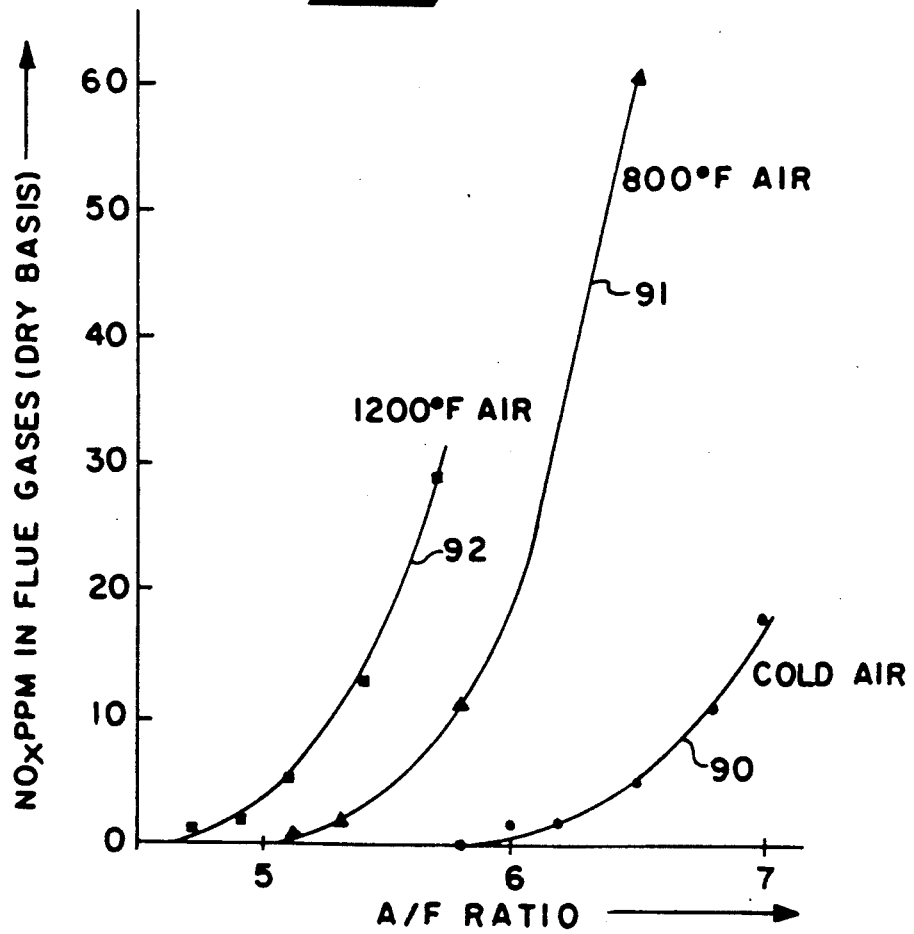
FIG. 5 is a developed graph, based on equilibrium conditions, showing $NO_x$ in flue gases on a ppm basis for various air/fuel ratios using combustion air in the burners at various temperatures.
Figure 6:
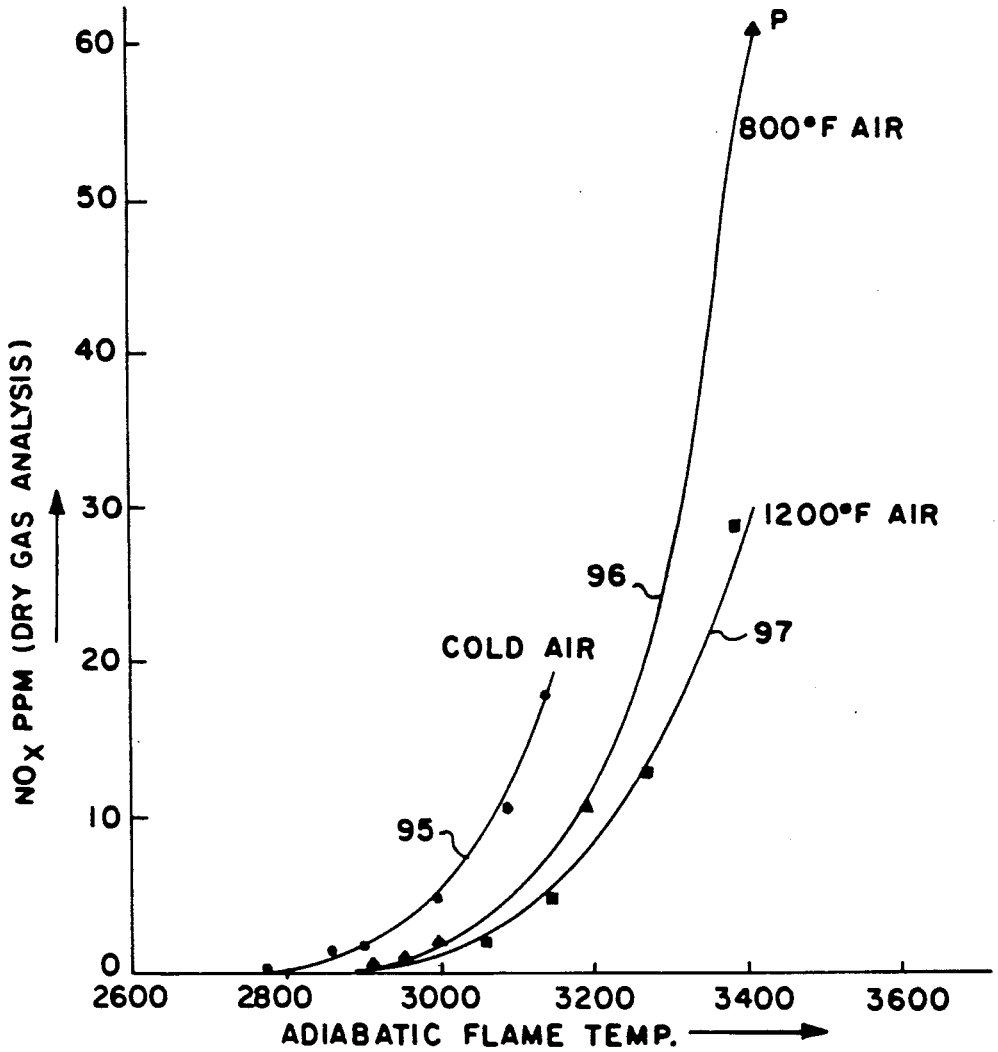
FIG. 6 is a developed graph, based on equilibrium conditions, showing $NO_x$ on a ppm basis (dry gas analysis) produced at different flame temperatures by burners using combustion air at various temperatures.

This fact forms one of the underpinnings of the present invention and is succinctly illustrated in the graphs shown in FIGS. 5 and 6. FIGS. 5 and 6 are graphs generated to succinctly illustrate process limitations and ranges used in the present invention and are not prior art. The graphs are based on equilibrium conditions. In FIG. 5, the air/fuel ratio is plotted on the x-axis and $NO_x$ emissions expressed on a dry basis are plotted in ppm. In the specifications thus far, it is simply stated the burner is to be operated to produce rich fumes. FIG. 5 dramatically illustrates the air/fuel burner ratios required to produce either negligible $NO_x$ or ppm less than the 9 ppm standard under consideration. The graph indicated by numeral 90 is typical for a burner operated with cold combustion air or air at ambient or room temperature. The graph indicated by reference numeral 91 is based on a burner using preheated combustion air at temperatures of 800° F. while the graph indicated by reference numeral 92 is based on a burner using preheated air at 1200° F. Thus, the air/fuel ratio must be turned down to lower values to generate the desired reducing atmosphere when the preheat temperature of the combustion air is increased and the correlation is shown in FIG. 5. FIG. 5 is to be worked with, checked or cross-referenced with FIG. 6 which graphs the $NO_x$ emissions on a ppm (dry gas analysis) basis on the y-axis as a function of the adiabatic flame temperature on the x-axis. As in FIG. 5, the curve indicated by reference numeral 95 in FIG. 6 is for a burner fired with cold or ambient temperature combustion air. The curve indicated by reference numeral 96 is for a burner using combustion air preheated to 800° F. and the curve indicated by reference numeral 97 is for a burner using combustion air preheated to 1200° F. It is to be understood that as the fuel/air ratio for each combustion air temperature increases the adiabatic flame temperature of the burner increases. Again, FIGS. 5 and 6 establish ranges at which the invention can be operated to produce $NO_x$ emissions which will satisfy proposed emission regulations and demonstrate how or at what operational temperatures and turn down ratios the burners employed in the invention are to be utilized to meet the desired emission levels with and without preheated combustion air. It is to be realized that when the temperature in step "a" of the invention is established at 2800° F., this is a relative value based on a burner using combustion air and one whereat measurable $NO_x$ emissions does not exist. In accordance with a broader scope of the invention, it is, of course, realized that the graphs in FIGS. 5 and 6 can be used to establish other temperature levels whereat an acceptable $NO_x$ emission level will occur.

It should be clear, though, that an industrial heating system where the heat produced for the work is generated simply by operating a burner to produce a highly reducing gas is not commercially feasible although such system would, in all probability, produce little $NO_x$ emissions. This is simply because the heat which is available chemically in the fuel is not used completely and because air pollutants in the form of $H_2$ and CO are formed and emitted. That is, the failure to use the heat available from the uncombusted combustibles renders the system inefficient. Further, a system which produces rich combustibles must dispose of the combustibles and when the combustibles are combusted, excessive flame temperatures are created and nitrous oxide forms.

The process of the present invention recognizes all such problems and provides, by the apparatus disclosed above, a mechanism which inherently corrects or addresses the factors which must be present to prevent nitrous oxide emissions. First, burner 40 is operated substoichiometrically to produce combustibles in its products of combustion, specifically carbon monoxide and hydrogen. The air/fuel ratio is maintained less than 7:1 and preferably at values which will produce products of combustion containing 10 to 15 percent hydrogen and 9 to 12 percent carbon monoxide. This is a very rich reducing atmosphere. Now it is known from enthalpy considerations in the steady state or equilibrium condition that the negative free energy ($\Delta G$) of oxide formation is such at certain temperatures that carbon monoxide will react with oxygen to produce $CO_2$ and that hydrogen will react with available oxygen to produce water vapor prior to nitrogen reacting with the available oxygen to produce nitrous oxide. It is also known from the "reburn" prior art that at given temperatures and for sufficiently long reaction time, nitrous oxide will react with the combustibles to produce free nitrogen, i.e. $NO_2+H_2 \rightarrow N_2+H_2O$ and $2NO_2+4CO \rightarrow N_2+4CO_2$. In my invention, the relatively cold spherical heat transfer balls 35 in the first segment 55 are functioning to progressively reduce the temperature of the products of combustion emanating from the burner. Importantly, spherical heat transfer balls 35 are sized relative to the diameter of track 21 to substantially occupy the space of the track, i.e. in excess of 90%, and a ball shape is chosen to provide the largest contact area between spherical object 35 and the products of combustion. In addition, counter-flow motion is used with the result that for the burner gases to flow down track 21 through second portion 24 a torturous flow path must be followed. This not only improves the heat transfer characteristics of the device but importantly extends the reaction time or the time at which the gases are held within segments 55, 56 and forces them into contact with hot surfaces. Since the temperature of the gases within the first segment 56 is continuously dropping vis-a-vis contact with spherical heat transfer objects 35, lower temperatures are progressively created for sufficient reaction times so that the combustibles can react with any nitrous oxide formations which may have sporadically occurred in the burner flame to dissipate nitrous oxides in first segment 55. Thus, the invention is accomplishing two important objects in first segment 55. First, by producing a rich atmosphere at a low temperature, tendency of nitrous oxides to form is reduced in view of the oxides formed with the combustibles while the energy or the heat liberated from the combustibles is not adversely acting to drive the temperature of the gases up because of the absorption of such heat by heat transfer objects 35. Secondly, the increased reaction time vis-a-vis the geometry of the ball-track configuration at progressively lower temperatures near the exit end of first segment 55 is reducing any nitrous oxide molecules previously formed such as by "hot spots" in the burner. The latter characteristic allows the invention to even operate at temperatures in excess of 2800° such as might occur with the use of preheat and/or excess air. The invention is thus tolerant of inadvertent $NO_x$ formation from the burner and is self-cleansing. At the point where the products of combustion enter second segment 56, they are virtually free of $NO_x$ emission and they have been cooled to a much lower temperature.

At this point, in order to recover available heat so that the process can be thermally efficient, completion air is introduced and mixed with the gases in second segment 56. It should be clear that the benefits obtained in preventing or reducing nitrous oxides emission by the presence of the combustibles are no longer available in second segment 56 since the combustibles are reacted with stoichiometric oxygen to produce additional heat. The process avoids nitrous oxide formation, however, by insuring that the gas entering second segment 56 is free of nitrous oxide as discussed above, and secondly, by controlling the temperature rise of the gas through previous heat exchange contact with spherical heat transfer objects 35 to insure that the gas temperature in second segment 56 does not exceed 2800° F. More specifically, heat transfer objects 35 in second segment 56 have been cooled sufficiently to limit any temperature rise as a result of completion burning such as not to exceed a final flame temperature of 2800° F. Preferably, the temperature of the products of combustion at the point where the gas enters second segment 56 and begins to mix with air is at a temperature not greater than about 1900° F. Because of the contact with successively cooler heat transfer balls 35 as the gas progresses towards exit point 29, the gas temperature is dropping. If combustion air preheat is used, heat can be removed from the combustion gases by cooling them with cold combustion air. Preferably, cooling should not go too far and should, as a rule, stay high enough to facilitate autoignition of the cooled combustion gases when hydrogen is mixed with the air. Nitrous oxide emissions do not form if the adiabatic flame temperature is prevented from going to too high temperatures and the system is virtually nitrous oxide free and certainly well under the 10 ppm standard currently being proposed by some states and well under the 20 ppm nitrous oxide emissions currently produced by state of the art systems which are being promoted as pollution abatement equipment. In addition to controlling the nitrous oxide emissions, the system is inherently producing high thermal efficiencies by contact and progressive heating of the spherical heat transfer objects 35. For example, temperature limits are established in the preferred embodiment so that burner temperature at first thermocouple 59 is controlled so as not to exceed 2800° F., cooling of the products of combustion are regulated by second thermocouple 60 so as not to exceed about 1900° F. and final control of stoichiometric flue gas temperatures sensed by third thermocouple 61 is within the range of anywhere from 500 to a maximum 1900° F. These temperature ranges result in a progressive heating of heat transfer objects from a low ball temperature at entry point 28 of just above the process temperature of the furnace to an intermediate temperature at completion air zone inlet 50 of below 2800° F. and a final temperature at exit point 29 which can be well below furnace temperature when combustion air preheat is used.

Figure 7:
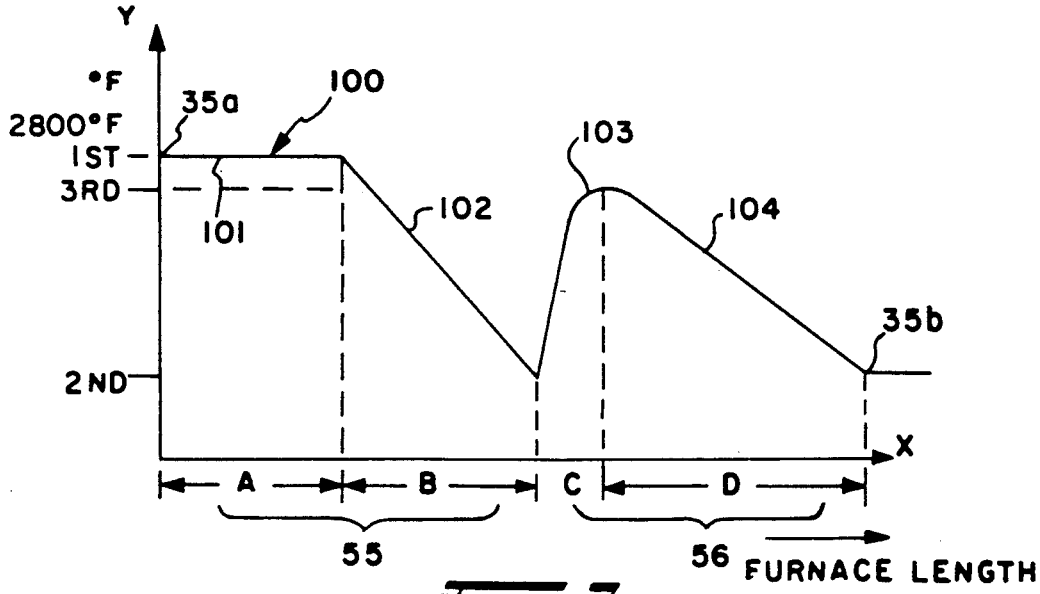
FIG. 7 is a graph of the process of the present invention showing process temperatures coordinated with the process steps in turn coordinated with the position or length of the furnace or heat track.

The process is graphically summarized in FIG. 7. In FIG. 7, the process is graphed as curve 100 and as a function of temperature on the y-axis versus either process steps or track or furnace length on the x-axis. In step a of the process, there is substoichiometric combustion producing a rich combustible gas at a temperature which does not exceed a predetermined first temperature range which is set at about 2800° F. based on the graphs disclosed in FIGS. 5 and 6 so that no $NO_x$ is produced. (Obviously, higher temperatures can be used according to FIGS. 5 and 6 and some $NO_x$ will result.) This temperature should be maintained for some discrete portion of first track segment 55 and it is optimally contemplated that $O_2$ can be injected over the discrete distance to maintain that temperature. This is shown by curve segment 101 in FIG. 7. The products of combustion are then cooled or heat removed to lower the temperature of the gases to a second predetermined temperature in step b of the process. (Each step of heat removal can be done by a combination of process heat or combustion air preheat utilization.) The heat removal in step b is shown by curved segment 102 and corresponds to the remaining portion of first track segment 55 extending up to completion air zone. At this time, the temperatures of the gases have dropped to the second temperature which is the lowest process temperature. The gases are then subjected to completion air from completion zone 50 and will immediately rise in temperature as shown in curve segment 103 which corresponds to step c. The temperature of the gases rise to a third predetermined temperature which, because there are no reducing agents or gases (i.e. no $H_2$ or CO) is set to be less than the first predetermined temperature. This is controlled by rate of completion air (i.e. completion air zone 50 can be extended) and the rate of heat removal. The heat removal continues in step d of the process where the temperature of the gases is brought down to flue exhaust temperature, i.e. **35*b*, and correlates to the balance of second track segment 56 and is shown by curve segment 104**.

It should also be noted that despite relatively low gas temperatures cited in the preferred embodiment, carbon deposition or carbon sooting does not occur. It is known that at gas temperatures of less than about 900°-1300° F., carbon deposition can occur from a disassociation of the combustibles, specifically carbon monoxide can disassociate to produce carbon and carbon dioxide and carbon monoxide and hydrogen can react to produce water vapor and carbon. Carbon deposition does not occur in second segment 56 because the system is controlled so that by the time the gas temperature has dropped to the disassociation levels, combustion of the combustibles has already occurred. It is also known that at higher temperatures, combustibles will similarly react in the absence of oxygen to produce carbon soot. However, carbon deposition does not occur in first segment 55 because the burner is designed specifically to not produce carbon at air/fuel ratios applicable to the proposed low $NO_x$ combustion process.

In the invention described in the preferred embodiment, the regenerative aspects of the heat sink/heat source heat transfer aspect of the invention has been described as a significant inventive aspect and especially so in combination with track 21 and spherical heat transfer objects 35 which permit the gaseous atmosphere to be closely controlled. It is also to be understood that the flue gases leaving flue outlet 45 are clean gases and can be used as a furnace atmosphere within furnace enclosure 13. Insofar as the invention concerns the reduction of nitrous oxide emissions, it should be clear that heat can be extracted from casing 20 and used in an industrial process separately and apart from the ball track concept disclosed. That is, first and second portions 23, 24 could exist without balls 35 and a heat exchanger or heat recuperator with two sections can be substituted for track 20. Heat from the gaseous products of combustion would be transmitted to the heat exchanger. The heat exchanger would be zoned to correlate with the four zones (i.e. heat produced by the burner at zone 1, heat extracted in first segment 55 which is zone 2, heat produced by completion air in second segment 56 which is zone 3, and remaining heat extracted in zone 4). The heat transfer efficiency of such an arrangement would not quite approach that of the preferred regenerative embodiment but is a completely analogous application of the same principles in reducing $NO_x$ emissions. The modification is discussed only for purposes of explaining that the invention can control nitrous oxide emissions apart from the track ball concept disclosed.

The inventive concept of the invention is based on the fact that $NO_x$ formation is reduced when maximum combustion temperatures are reduced and when hydrogen is present in the flame by combusting natural gas with insufficient oxygen.

The effect of reaction temperature on $NO_x$ formation has been investigated extensively in the past. Prior art results indicate that $NO_x$ formation is reduced significantly when the reaction temperature drops below 2800° F. (1800° K.). It also indicates that the presence of excess oxygen, at excess air firing, tends to increase $NO_x$ formation near the stoichiometric conditions.

There is insufficient information in the literature to predict $NO_x$ levels at high hydrogen levels in reacting gases. However, literature data show that $NO_x$ disappears completely when the hydrogen rich gases contain combustible gases such as hydrogen and carbon monoxide. FIG. 3 includes theoretical and experimental results for $NO_x$ formation at sub-stoichiometric firing conditions of natural gas. Under these conditions, the products of combustion contain relatively large amounts of hydrogen. The $NO_x$ formation is practically zero below an air/fuel ratio of 7. As discussed, at these conditions combustion products are at relatively lower temperature and contain moderate amounts (10 to 15%) of hydrogen.

In the invention, the flame gases are then cooled continuously to even lower temperatures. At sufficiently low temperatures it is then safe to supply additional oxygen, burn the hydrogen and carbon monoxide and extract all the remaining heating value from the fuel. The temperature rise resulting from this afterburning step is controlled to avoid excessive combustion temperatures. The gases can be further cooled to exhaust at very low temperatures (about 500° F.) at which temperature one can expect thermal efficiencies in excess of 80 percent.

The combustion system concept includes four major sections. They are: a fuel rich combustion zone, a heat transfer and heat extraction zone to reduce temperatures of combustion products, a reburn zone to complete the combustion of intermediary combustion products, and a second heat transfer and heat extraction zone. The heat transfer zone and the reburn zone are an integral part of the heating equipment such as a furnace, an oven, or a heater. The functions and contributions each of these sections are discussed below.

The rich combustion zone consists of a burner which is supplied with air and natural gas at sub-stoichiometric air/fuel ratio. The burner will produce combustion products which contain as much as 10% to 15% hydrogen and 9% to 12% carbon monoxide, both of which are highly reducing gases and have a strong chemical affinity for $NO_x$.

It should be noted that this combustion technique also allows one to keep the adiabatic reaction temperature in the reaction zone well below 2800° F. by adjusting the air/fuel ratio. Even when preheated combustion air or oxygen enrichment are used, flame temperatures can still be controlled at the same, low temperature. In fact, air preheat and oxygen enrichment, the two most effective energy conservation measures for high temperature processes, will produce more hydrogen and carbon monoxide. FIGS. 2, 4, 5 and 6 show the variation of "flame" temperature and composition of flue gases for natural gas composition respectively. Of particular interest is the region where the air/fuel ratio is sub-stoichiometric where the combustion air supply is less than what is required for complete combustion of natural gas. At sub-stoichiometric conditions, the flame temperature drops below 2800° F. while the flue gases contain rather large amounts of hydrogen and carbon dioxide. Both of these conditions are highly effective in reducing $NO_x$ formation. Sub-stoichiometric combustion of natural gas has been carried out on a routine basis in the metal heat treat industry.

The data and discussions presented earlier, show that $NO_x$ formation is greatly reduced under fuel rich or reducing conditions. At very high concentrations of hydrogen and carbon monoxide (contents of hydrogen and carbon monoxide are in the range of 10%) $NO_x$ concentration can be "zero" or non-measurable for all practical purposes.

In addition, it has been shown experimentally that $NO_x$ will react in a reaction similar to the reburning reaction with reducing agents like hydrogen and carbon monoxide to form harmless nitrogen and oxygen. Therefore, the combination of low reaction temperatures and presence of reducing gases in the combustion section assures that no appreciable $NO_x$ is formed during this stage of the proposed modified natural gas/air combustion.

To generate the low temperatures and high hydrogen concentrations in the reaction zone, the air to fuel ratio is maintained well below stoichiometric ratios. As a result, the combustion temperatures are lowered, significant amounts of reducing species are generated and $NO_x$ formation is suppressed. Experimental evidence exists that shows that reaction between $NO_x$ and hydrogen occurs at higher temperatures homogeneously (in the gas phase), and at lower temperatures heterogeneously (on a surface which can be a catalyst or just an intermediary reaction site).

The residual gases, after completed reduction of any traces of $NO_x$ and after cooling down, are reacted with a controlled amount of combustion air to complete combustion of residual gases and to extract the remaining heat content. The heat from the flue products is extracted in this cooling section and is used within the heating system prior to the discharge of cooled, completely reacted combustion products into the atmosphere. The flue gas temperature can be reduced to obtain greater than 75% thermal efficiency. As a result, emission of carbon dioxide, a clean emission but responsible for the greenhouse effect, is minimized.

As mentioned earlier, most experimental work related to $NO_x$ reduction has been carried out under "lean" or stoichiometric combustion conditions. At this time, very little directly applicable data is available on the formation of $NO_x$ during natural gas combustion under rich conditions. Also, no data is available to safely predict maximum allowable temperatures during the completion combustion step. However, recent successes of the reburning process, which also uses hydrogen and carbon monoxide gases to reduce nitrogen oxides in boiler flue gases, indicate that the presence of such gases reduces or eliminates formation of $NO_x$.

The invention discussed herein presents the potential of continued use of natural gas in industrial and commercial heating applications while complying with the most severe present and future environmental regulations in Southern California and the U.S.

The invention has been described with reference to a preferred embodiment and several modifications or alterations thereof. It will be obvious to those skilled in the art upon reading and understanding the invention as described above to make further alterations and modifications. For example, heat transfer objects 35 could be coated with an oxidation catalyst, such as nickel compounds, which would act to speed reaction times to reduce any nitrous oxide emissions formed in first segment 55. The catalyst would then also speed the combustion reaction occurring in second segment 56. Further, while spherical shapes are preferred for heat transfer objects, other shapes could be used. It is intended that all such modifications and alterations are included herein insofar as they come within the scope of the invention.

Having thus defined the invention, it is claimed:

1. An industrial thermal process for heating work with reduced $NO_x$ emissions comprising the following sequential steps:

a) combusting a gaseous fuel with combustion air at a sub-stoichiometric ratio which is sufficient to generate a reducing atmosphere having products of combustion rich in hydrogen and carbon monoxide combustibles, b) while immediately cooling the atmosphere to a predetermined temperature by passing same through a tortuous heat treat path wherein removed heat is used to heat work and wherein oxygen in said atmosphere continues to react with said products of combustion to produce an atmosphere substantially free of $NO_x$, and c) thereafter adding completion air to said reducing atmosphere which is sufficient to combust said hydrogen and carbon monoxide combustibles while continuously controlling the temperature of said gaseous products by regulating the rate at which said gases receive said completion air to be below said predetermined temperature whereat $NO_x$ tends to occur.

2. The process of claim 1 wherein said gaseous fuel is natural gas and said sub-stoichiometric ratio is established as a ratio of combustion air to fuel which does not exceed the ratio of seven to one.

3. The process of claim 1 wherein said products of combustion in step (a) will include as much as 10 to 15% hydrogen and as much as 9 to 12% carbon monoxide and preferably less.

4. The process of claim 3 wherein said predetermined temperature does not exceed approximately 2800° F.

5. The process of claim 4 wherein said atmosphere is generated at a temperature which does not exceed about 2800° F. which is cooled prior to the addition of completion air to a temperature which does not exceed about 1600° F. predetermined temperature of said gases allow completion air is provided does not exceed about 1900° F.

6. The process of claim 1 further including a catalyst in the completion air step for speeding the reaction of combustion air with said hydrogen and carbon monoxide.

7. The process of claim 1 further including the step of preheating said combustion air used in step (a).

8. The process of claim 1 wherein said cooling in said tortuous path occurs by direct contact of said gases with cool objects to effect heat transfer.

9. The process of claim 1 wherein the temperature of gases produced in the completion air step is controlled by sequentially adding completion air at controlled rates.

10. The process of claim 1 wherein prior to said completion air step, combustion air is sequentially added during a portion of the cooling of said atmosphere to maintain said products of combustion at temperatures approximately close to said predetermined temperature.

11. An industrial thermal process for heating work with reduced $NO_x$ emissions comprising the following sequential steps:

a) combusting a gaseous fuel with combustion air at a sub-stoichiometric ratio which is sufficient to generate a reducing atmosphere rich in hydrogen and carbon monoxide combustibles;

b) removing a portion of the heat generated in step (a);

c) adding completion air to said reducing atmosphere which is sufficient to combust said hydrogen and carbon monoxide combustibles, while controlling the temperature of said gaseous products in steps (b) and (c) to be below a predetermined temperature whereat $NO_x$ tends to occur;

d) directly contacting said gases with cool objects to effect heat transfer therewith to control the gas temperature by providing a plurality of heat transfer objects rolling within a sealed, closed loop track, said track arranged so that a first portion thereof extends within a sealed furnace in heat transfer relationship with work disposed therein and a second portion thereof is insulatedly removed from said first portion, said second portion having a first segment adjacent the point where said objects enter the first track portion in said furnace enclosure and a second segment contiguous with said first segment and adjacent the point where said objects leave said first track portion in said furnace enclosure; and e) performing steps a-d in said second track portion and reducing the temperature of said objects by indirect heat transfer to the work in said first track portion.

12. The process of claim 11 further including the step of moving said objects which are relatively cool from said first track portion sequentially through said second segment, then through said first segment and back to said first track portion, and adding said combustion air in step (c) in said second segment tending to heat said objects by contact with said products of combustion to said third predetermined temperature;

cooling said products of combustion in steps (b) and (c) by contacting said products of combustion with said objects in said first and second segments while heating said objects in said first and second segments to temperatures tending to approach said predetermined temperatures by contact with said products of combustion whereby said objects function as a heat sink in said second track portion to control the temperature of said products of combustion to minimize $NO_x$ formation while also functioning as a heat source in said first track portion to indirectly heat said work in said furnace enclosure.

13. The process of claim 1 further including the step of (d) exhausting said products of combustion after completion of step (c) and said $NO_x$ emissions in said exhaust do not exceed 9 parts per million.

14. A thermal system for heating work to a predetermined temperature comprising:

a) a furnace having a sealed furnace enclosure in which work to be heated is placed;

b) a casing having an uninsulated first portion extending within said furnace enclosure and a second portion insulated from said furnace enclosure, said casing defining a continuous, sealed closed loop track extending through said first and second portions each of which is defined by an entry point and an exit point and arranged so that the entry point of one portion is adjacent the exit point of the other portion;

c) a plurality of heat transfer objects within said track and means for moving said objects about said track from said entry to said exit points of said portions;

d) burner means generally adjacent said exit point of said second portion for firing products of combustion from said exit point towards said entry point of said second portion;

e) burner regulator means controlling the ratio of fuel and combustion air to said burner means to assure substoichiometric combustion of said burner means to produce products of combustion having hydrogen and carbon monoxide as elements thereof;

f) completion air means intermediate said exit and entry points of said second portion for supplying combustion air in stoichiometric proportion at controlled flow rates to assure combustion of said hydrogen and carbon monoxide whereby said objects are heated in said second portion from contact with said products of combustion and cooled in said first portion from said work while the temperature of said products of combustion are controlled by contact with said objects to assure that said products of combustion do not exceed a predetermined temperature to minimize formation of $NO_x$ emissions.

15. The system of claim 14 further including first temperature sensing means in said first portion for sensing the temperature of said products of combustion produced from said burner means and in response to temperatures exceeding a first predetermined temperature, controlling said regulator means to decrease the air to fuel ratio supplied to said burner means.

16. The system of claim 14 further including said second portion of said track having first and second contiguous segments, said first segment adjacent said second portion's exit point and said second segment adjacent said second portion's entry point;

said burner means includes a burner adjacent said first segment orientated to fire its products of combustion counter to the direction of movement of said objects in said track's second portion;

said completion air means including an outlet for combustion air in said second segment of said second portion;

an outlet for collecting spent products of combustion in said second segment of said track's second portion adjacent the entry point thereof whereby said objects are progressively heated as they travel in said track's second portion from said entry to said exit end while said products of combustion from said burner are controlled in temperature by contact with said objects.

17. The system of claim 16 further including temperature sensing means in said first and second segments for sensing the temperature of said products of combustion in said segments and in response to temperatures exceeding a predetermined limit controlling any one or more of the following:

a) means to cause said moving means to increase the speed of said objects about said track;

b) means to cause said regulator means to lower the air to fuel ratio supplied to said burner; and c) means to cause said air completion means to lower the rate at which said completion air is supplied to said outlet.

18. An industrial process for generating a heated gas with minimal $NO_x$ content for heating work comprising the steps of:

a) combusting natural gas with combustion air at substoichiometric proportions sufficient to generate a reducing atmosphere having products of combustion rich in hydrogen and carbon monoxide combustibles;

b) immediately cooling said atmosphere to a first predetermined temperature by directly contacting said atmosphere with cool objects providing a tortuous flow path to establish a sufficient reaction time whereby said products of combustion continue to react with oxygen to produce an atmosphere rich in combustibles with substantially no $NO_x$, and c) thereafter adding completion air to said reducing atmosphere sufficient to combust said hydrogen and carbon monoxide combustibles while continuously controlling the temperature at a second predetermined temperature and the rate of flow of said completion air to minimize the formation of $NO_x$.

19. The industrial process of claim 18 further including the step of directly contacting said gases in said completion air step with objects at varying temperatures to control the temperature of said gases while sequentially adding said completion air at various positions relative to said objects.

20. The industrial process of claim 18 wherein said hydrogen comprises about 10 to 15% of the gas produced in step (a) and said carbon monoxide comprises about 9 to 12% of the gas produced in step (a).

* * * * *